US008118033B2

(12) United States Patent
Sendo et al.

(10) Patent No.: US 8,118,033 B2
(45) Date of Patent: Feb. 21, 2012

(54) APPARATUS FOR MANUFACTURING ROD-SHAPED SMOKING ARTICLES

(75) Inventors: Makoto Sendo, Tokyo (JP); Toshio Yanagi, Tokyo (JP); Akihiro Inoue, Tokyo (JP); Tomoichi Watanabe, Tokyo (JP); Manabu Takeuchi, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 704 days.

(21) Appl. No.: 11/812,066

(22) Filed: Jun. 14, 2007

(65) Prior Publication Data

US 2007/0240726 A1 Oct. 18, 2007

(51) Int. Cl.
*A24B 15/00* (2006.01)
*A24B 15/28* (2006.01)

(52) U.S. Cl. ..... 131/62; 131/58; 131/274; 131/60; 131/34; 131/280; 131/282; 131/284

(58) Field of Classification Search ..... 131/62
See application file for complete search history.

(56) References Cited

U.S. PATENT DOCUMENTS

| | | | | |
|---|---|---|---|---|
| 3,850,177 | A * | 11/1974 | Labbe | 131/66.1 |
| 4,186,754 | A | 2/1980 | Labbe | |
| 4,617,945 | A * | 10/1986 | Vos et al. | 131/310 |
| 4,619,276 | A * | 10/1986 | Albertson et al. | 131/79 |
| 4,726,523 | A * | 2/1988 | Kokubo et al. | 239/102.2 |
| 4,993,434 | A | 2/1991 | Haws et al. | |
| 4,995,405 | A * | 2/1991 | Lettau | 131/84.1 |
| 5,370,137 | A * | 12/1994 | Kushihashi et al. | 131/84.2 |
| 5,615,693 | A | 4/1997 | Saitoh | |
| 5,727,571 | A | 3/1998 | Meiring et al. | |
| 6,263,881 | B1 | 7/2001 | Kuhl et al. | |
| 6,273,093 | B1 | 8/2001 | Oliver et al. | |

FOREIGN PATENT DOCUMENTS

| | | | |
|---|---|---|---|
| DE | 10052408 | A1 | 5/2002 |
| EP | 0 172 654 | A1 * | 2/1986 |
| EP | 0172654 | A1 | 2/1986 |
| EP | 0 405 929 | A2 | 1/1991 |
| EP | 0405929 | A2 | 1/1991 |
| JP | 53-18800 | A | 2/1978 |
| JP | 3-39076 | A | 2/1991 |
| JP | 8-214854 | A | 8/1996 |
| JP | 3209985 | B2 | 7/2001 |
| JP | 2001-512321 | A | 8/2001 |

(Continued)

*Primary Examiner* — Philip Tucker
*Assistant Examiner* — Vicki Wu
(74) *Attorney, Agent, or Firm* — Birch, Stewart, Kolasch & Birch, LLP

(57) ABSTRACT

An apparatus for manufacturing rod-shaped smoking articles which includes a forming section (10) for forming a material layer (K) made up of particles of smoking material and delivering the formed material layer (K); a wrapping section (20) disposed downstream of the forming section (10), for forming a rod (KR) by wrapping the material layer (K) in a web (W); a pair of guide blocks (54) disposed in the terminal end portion of the forming section (10), for guiding the material layer (K); a web shield (56) disposed downstream of the guide blocks (54) as viewed in the direction of delivering the material layer (K), for separating the material layer (K) and the web (W) from each other; a tongue (40) disposed in the start end portion of the wrapping section (20); and injection openings (64, 70, 76) provided to the guide blocks (54), the web shield (56) and the tongue (40), for injecting a liquid flavor additive into the material layer (K).

8 Claims, 6 Drawing Sheets

FOREIGN PATENT DOCUMENTS

| | | | |
|---|---|---|---|
| JP | 3472591 | B2 | 9/2003 |
| SU | 95990 | A1 | 1/1953 |
| SU | 1087049 | A | 4/1984 |
| SU | 1295991 | A3 | 7/1987 |
| UA | 67817 | C2 | 7/2004 |
| UA | 80784 | C2 | 10/2007 |
| UA | 88657 | C2 | 11/2009 |

* cited by examiner

APPARATUS FOR MANUFACTURING ROD-SHAPED SMOKING ARTICLES

TECHNICAL FIELD

The present invention relates to an apparatus for manufacturing rod-shaped smoking articles such as cigarettes and substitutive cigarettes, and more specifically, to a manufacturing apparatus capable of adding an additive to smoking material for rod-shaped smoking articles.

BACKGROUND ART

For instance, Japanese Patent No. 3472591 discloses a substitutive cigarette. This substitutive cigarette includes a fuel element and an aerosol-generating chip. The fuel element and the aerosol-generating chip are each formed into a rod. When the substitutive cigarette disclosed in the document is smoked, the fuel element is first ignited. The burning heat of the fuel element heats the aerosol-generating chip, and the heated aerosol-generating chip generates aerosol. Such aerosol is inhaled by a smoker through a filter of the substitutive cigarette.

An aerosol-generating source disclosed in the document is produced by the following procedure.

First, filling material obtained by adding an aerosol-generating substance to particles of smoking material is prepared. Such filling material is supplied to a manufacturing apparatus with a wrapping material, or web. The manufacturing apparatus wraps the filling material in the web and forms an aerosol-generating rod. Thereafter, the aerosol-generating rod is cut into pieces of a given length, and in result, discrete aerosol-generating chips are obtained.

Since the filling material is prepared outside the manufacturing apparatus, the manufacture of substitutive cigarettes requires a preparation device for preparing the filling material in addition to the manufacturing apparatus. Equipment for manufacturing substitutive cigarettes is therefore large-scale.

For that reason, it can be considered to prepare a solution containing an additive such as an aerosol-generating substance and to add this solution to the smoking material in the manufacturing apparatus.

For the addition of the solution to the smoking material, technologies disclosed, for example, in Japanese Patent Application Publication No. 53-18800 and Japanese Patent No. 3209985 can be employed. The former technology discharges solution such as water from the inside of a tongue arranged in a manufacturing apparatus, and by so doing, prevents a gum-like film from being formed in the inside of the tongue. The tongue compresses and molds the smoking material into a rod in cooperation with a molding bed and garniture tape of the manufacturing apparatus before the smoking material is wrapped in the web.

According to the latter technology, when the smoking material is sucked in layers by a suction band of the manufacturing apparatus, and this material layer is injected with a liquid flavor additive.

However, both the technologies have only one injection position for an additive in a transfer path of the smoking material, so that they are not capable of efficiently adding the additive to the smoking material running through the transfer path at high speed.

Furthermore, if the former technology is employed, a liquid additive discharged from the tongue is contained only in the upper portion of the rod-shaped smoking material. Accordingly, when the rod-shaped smoking material is subsequently wrapped in the web, and the aerosol-generating rod is produced, a lap portion formed by superposing the side edges of the web on each other gets damp too much with the liquid additive. As a result, an adhesion defect is prone to occur in the lap portion, so that it is impossible to stably produce the aerosol-generating rod, or rod-shaped smoking article.

If the latter technology is employed, in a process of forming a material layer on the suction band, the liquid additive is injected into the material layer. Therefore, the unit length weight of the material layer becomes heavy, and moreover, the injected liquid additive hampers the suction band from sucking the smoking material. Consequently, the formation of the material layer, namely that of the rod-shaped smoking article, becomes unstable.

DISCLOSURE OF THE INVENTION

It is an object of the present invention to provide an apparatus for manufacturing rod-shaped smoking articles, which is capable of effectively adding a liquid additive into smoking material while securing stable manufacture of the rod-shaped smoking articles.

In order to accomplish the object, an apparatus for manufacturing rod-shaped smoking articles of the present invention comprises a forming section including a forming path, for forming a material layer made up of particles of smoking material on the forming path and delivering the material layer along the forming path; a wrapping section including a wrapping path, for receiving the material layer from the forming path of the forming section, for forming a rod in which the material layer is continuously wrapped in a web in the process where the material layer travels along the wrapping path and delivering the formed rod, the wrapping section in which the rod has a lap portion formed by bonding both side edges of the web together in a state where the side edges are superposed upon each other; a cutting section for cutting the rod delivered from the wrapping section into rod-shaped smoking articles having given length; and an addition device for adding a liquid additive to the material layer in an area between a terminal end portion of the forming path and a start end portion of the wrapping path. The addition device is disposed in the area and includes a plurality of injection openings for injecting the additive into the material layer. The injection openings are spaced from each other in a traveling direction of the material layer and also in a circumferential direction of the material layer.

In the above-mentioned manufacturing apparatus, when the material layer runs through the area between the terminal end portion of the forming path and the start end portion of the wrapping path, the liquid additive, or more specifically, a liquid flavor additive containing alcohols, is injected from the injection openings into the material layer. For example, glycerin, propylene glycol (PG), menthol dissolved in alcohol or the like may be used as a liquid flavor additive of the above-mentioned kind.

Since the injection openings are spaced from each other in the traveling and circumferential directions of the material layer, the additive can be efficiently injected into the material layer.

The injection openings are located in the area between the terminal end portion of the forming path and the start end portion of the wrapping path. Therefore, the injection of the additive does not adversely affect the formation of the material layer on the forming path. Moreover, it is possible to easily secure spaces for the injection openings.

Since the addition device has the plurality of injection openings, a total injection amount of the additive required in the material layer can be apportioned to each injection opening, which makes it possible to reduce an injection amount of the additive to be injected from each injection opening.

More specifically, the forming section may include a pair of guide members disposed in the terminal end portion of the forming path, for guiding both sides of the material layer. The wrapping section may further include a compression member disposed in the start end portion of the wrapping path, for compressing the material layer from above and a web shield placed in the start end portion of the wrapping path, for separating the material layer and the web from each other. In this case, at least two among the guide member, the compression member and the web shield have the respective injection openings.

In this case, the injection openings of the guide member, the compression member and the web shield can inject the additive into the material layer from the sides, above and beneath of the material layer.

In a case that the compression member has the injection opening, the injection opening is preferably positioned so as to avoid a portion of the material layer, which is covered with the lap portion of the web. In this case, the injected additive never wets the lap portion of the web. However, when the web shield has the injection opening, the injection opening is preferably positioned upstream from the compression member as viewed in the traveling direction of the material layer. Again, the injected additive never humidifies the web.

Since the web and the lap portion of the web do not get damp with the additive, the rod is stably formed.

Furthermore, when the material layer passes the injection opening of the web shield, the material layer is not compressed yet. This makes it possible to inject the additive into material layer through the injection opening of the web shield without difficulty.

The addition device may further include regulation means for controlling the injection amount of the additive to be injected from the injection openings according to traveling speed of the rod. In this case, the addition device can evenly add the additive into the rod-shaped smoking article regardless of speed of manufacturing the rod.

The addition device may further include control means for intermittently halting the injection of the additive for the purpose of avoiding the injection of the additive into predetermined cut points of the rod. In this case, the addition device prevents the additive from adhering to a cutter of the cutting section.

As the injection opening, a jet orifice of a spray nozzle or a discharge orifice of a microsolenoid valve may be used. The spray nozzle and the microsolenoid valve are small in size, so that they can be disposed near a travel path of the material layer.

The above-mentioned additive is a liquid flavor additive containing an alcohol. Liquid flavor additive of this kind may include, for example, glycerin, propylene glycol (PG), or menthol dissolved in alcohol, etc.

BEST MODE OF CARRYING OUT THE INVENTION

Figure 1:
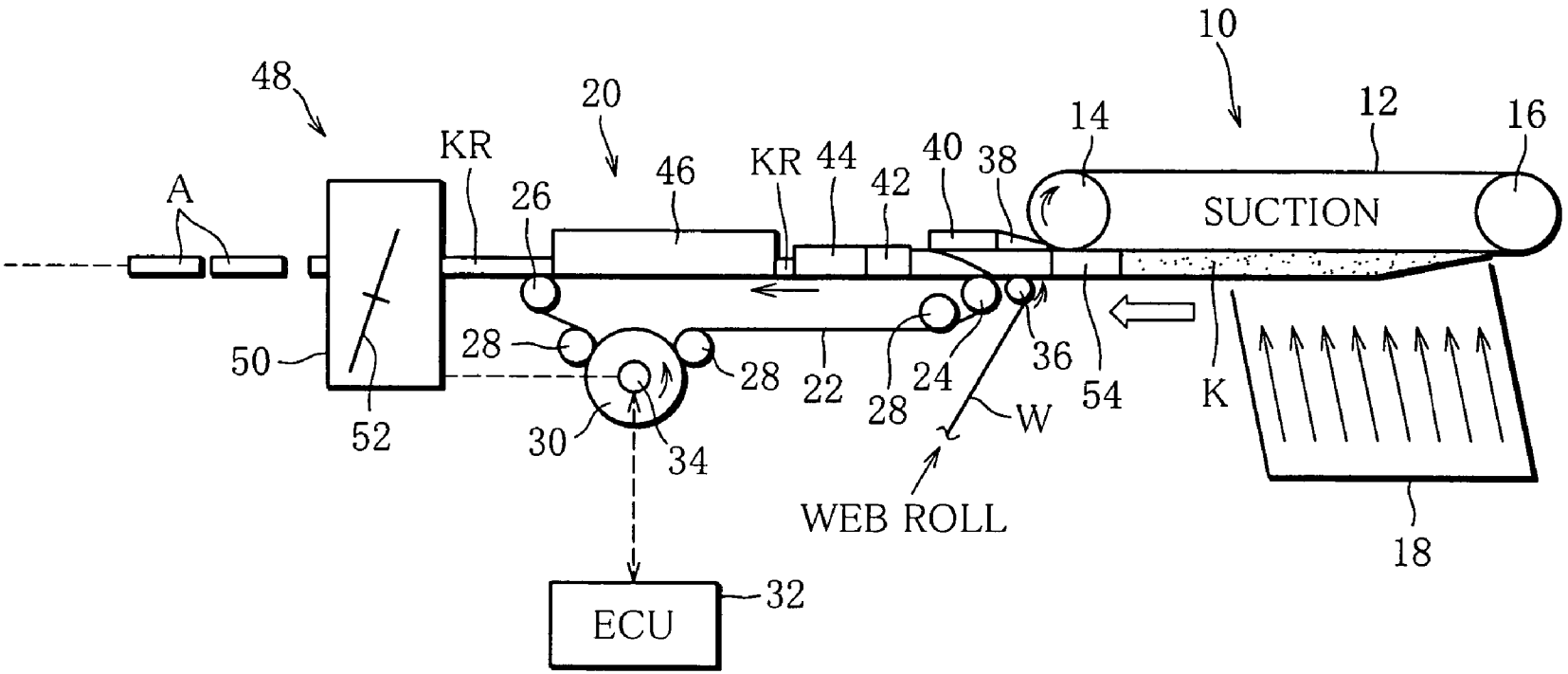
FIG. 1 is a view schematically showing a configuration of a manufacturing apparatus.

FIG. 1 schematically shows an apparatus for manufacturing rod-shaped smoking articles.

The manufacturing apparatus has the same configuration as a configuration of an apparatus for manufacturing cigarette rods. Therefore, the basic configuration of the manufacturing apparatus will be briefly described below.

The manufacturing apparatus has a forming section 10 for a material layer. The forming section 10 is placed on the right side of FIG. 1. The forming section 10 has an endless suction band 12. The suction band 12 extends between a driving roller 14 and a driven roller 16. The rollers 14 and 16 are spaced from each other in a horizontal direction. When the driving roller 14 is rotated, the suction band 12 runs in one direction, and a lower band portion of the suction band 12 forms a forming path for the material layer.

A chimney 18 is disposed immediately under the suction band 12 so as to be located on the side of the driven roller 16. Particles of smoking material are supplied from a supply source, not shown, into the chimney 18. The chimney 18 blows up the smoking material contained in the inside thereof toward the suction band 12.

The smoking material that has been blown up is sucked by the running suction band 12 to be stratified on a lower surface thereof. This forms a material layer K on the suction band 12. Accordingly, the material layer K proceeds with the suction band 12 and is transferred in the left direction in FIG. 1.

The smoking material here is shred tobacco obtained by cutting a sheet-like reconstituted tobacco, shred tobacco subjected to an expanding process or a mixture of these two kinds of shred tobacco.

A wrapping section 20 is adjacently disposed at the left side of the forming section 10.

The wrapping section 20 includes endless garniture tape 22. The garniture tape 22 extends between a pair of tape rollers 24 and 26. The tape rollers 24 and 26 are also spaced from each other in the horizontal direction. An upper tape portion of the garniture tape 22 passes over a bed, not shown, and forms a wrapping path in cooperation with a molding groove of the bed. The wrapping path horizontally extends in alignment with the forming path. There is secured given space between a start end portion of the wrapping path and a terminal end portion of the forming path.

A lower tape portion of the garniture tape 22 is guided by a plurality of guide rollers 28 and passes around a tape drum 30. The garniture tape 22 runs when the tape drum 30 is rotated. The tape drum 30 is rotated by a motor, not shown. Rotation of the motor is controlled by an electronic control unit (ECU) 32.

The tape drum 30 has a drum shaft to which a rotary encoder 34 is fixed. The rotary encoder 34 detects rotation speed of the tape drum 30, namely, running speed of the garniture tape 22, and supplies a signal indicative of the running speed to the electronic control unit 32.

There is disposed a roller-shaped web guide 36 in between the start end portion of the wrapping path and the terminal end portion of the forming path. The web guide 36 directs web W such as paper that is drawn out from a web roll onto the upper tape portion of the garniture tape 22.

The wrapping section 20 includes a shoe 38 and a tongue 40 in the start end portion of the wrapping path. The shoe 38 and the tongue 40 are successively arranged in the order named from the driving roller 14 side. The shoe 38 has a wedge-shaped edge located close to the driving roller 14 and peels off the material layer K from the suction band 12. The material layer K that has been peeled off is supplied onto the web W in the start end portion of the wrapping path.

After being transferred onto the web W, the material layer K passes through the tongue 40 with the garniture tape 22 and the web W as the garniture tape 22 runs. In this process, the tongue 40 compresses the material layer K from above in cooperation with the bed and forms an upper portion of the material layer K into a circular arc in cross-section.

In the process where the garniture tape 22 runs from the start end portion of the wrapping path toward the tongue 40, the molding groove of the bed gradually forms the garniture tape 22, or web W, in the shape of letter U in cross-section. As a result, the molding groove compresses a lower portion of the material layer K in cooperation with the tongue 40 and molds the lower portion into a circular arc in cross-section. In short, the material layer K is compressed from above and beneath to be formed into a rod-shape.

In the wrapping path, a short holder 42, a long holder 44 and a heater unit 46 are successively arranged downstream of the tongue 40. When the web W passes through the short holder 42 and the long holder 46 with the material layer K, the holders 42 and 44 continuously wrap the material layer K in the web W through the garniture tape 22, to thereby form a rod KR.

More specifically, the short holder 42 bends one side edge of the web W in the shape of a circular arc so that the one side edge of the web W is placed over the material layer K. In this process, the other side edge of the web W is applied with glue by a glue-application nozzle, not shown. Subsequently, the long holder 44 bends the other side edge of the web W in the circular arc-like shape as with the one side edge and places the other side edge of the web W over the material layer K. As a result, both the side edges of the web W are superposed on each other and bonded together with glue, thereby forming a lap portion of the rod KR.

Thereafter, when the rod KR passes through the heater unit 46, the glue applied to the lap portion is dried by the heater unit 46. The rod KR is then continuously delivered from the wrapping section 20.

A cutting section 48 is placed downstream of the wrapping section 20. The cutting section 48 includes a cutter casing 50 that allows the rod KR to pass therethrough and a rotatable cutter disc 52 contained in the cutter casing 50. The cutter disc 52 has one or more cutter blades, not shown, in an outer circumferential edge thereof. The cutter blades are arranged at regular intervals in a circumferential direction of the cutter disc 52.

The rod KR is cut into pieces with given length as the cutter disc 52 rotates. This produces discrete rod-shaped smoking articles A. The cutter disc 52 and the tape drum 30 are connected to each other through a power transmission path, not shown. The cutter disc 52 rotates at rotation speed corresponding to rotation speed of the tape drum 30, namely, running speed of the rod KR. Consequently, the cutter disc 52 can cut the rod KR into pieces with given length regardless of the running speed of the rod KR.

Figure 2:
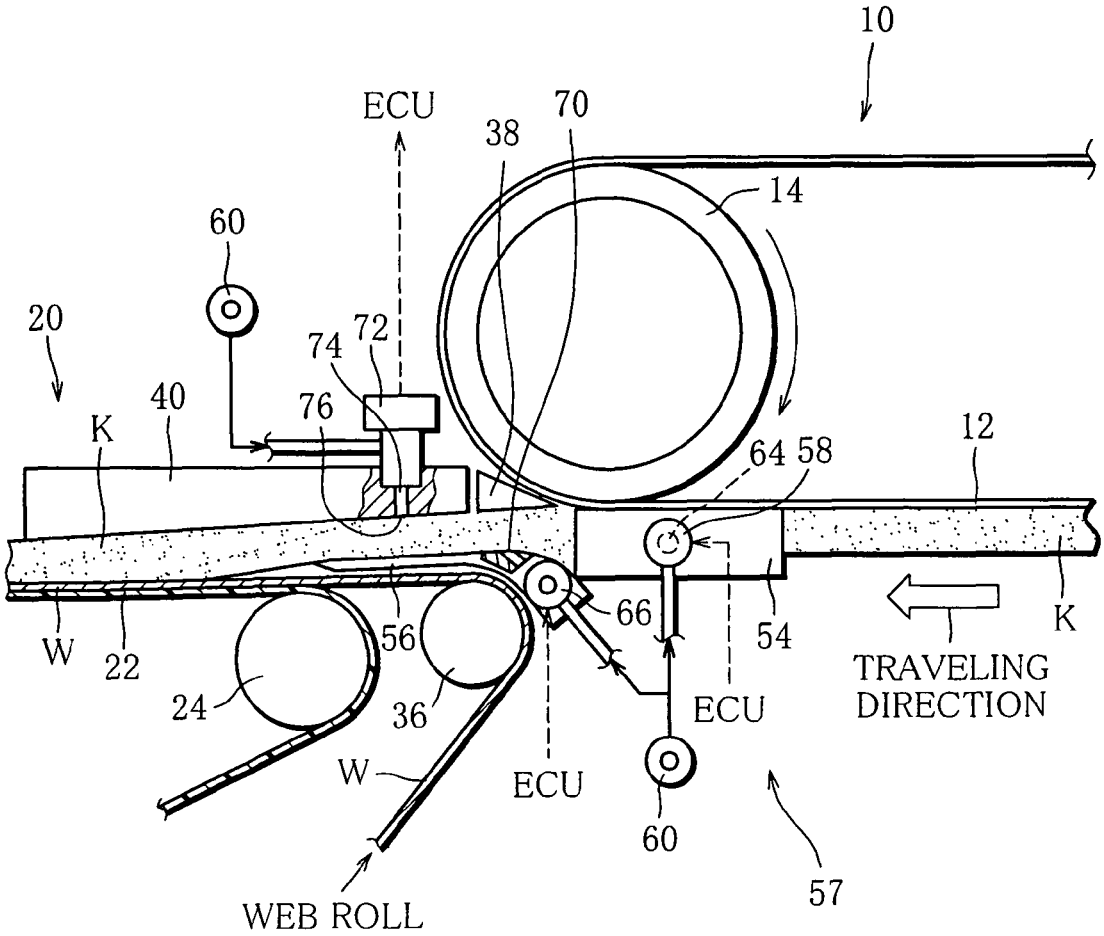
FIG. 2 is a view showing a part of the manufacturing apparatus of FIG. 1 in an enlarged scale.

FIG. 2 shows in more detail an area between the terminal end portion of the forming path to the start end portion of the wrapping path.

The forming path has a pair of guide blocks 54 in the terminal end portion thereof. The guide blocks 54 are arranged in both sides of the forming path under the driving roller 16, to thereby guide both sides of the material layer K.

A web shield 56 extends from the guide blocks 54 toward the tape roller 24 of the wrapping path. The web shield 56 is spaced apart with a given gap from the web W between the web guide 36 and the tape roller 24. The web shield 56 guides the shred layer K to transfer from the forming path onto the web W and separates the web W and the material layer K from each other until the web W is superposed on the garniture tape 22.

As is apparent from FIG. 2, the tongue 40 extends over the tape roller 24 and the web guide 36, and has an upstream end that is located above the web guide roller 36.

The guide blocks 54, the web shield 56 and the tongue 40 are provided with respective injection openings of an addition device 57 of one embodiment. The addition device 57 will be described below.

The addition device 57 includes an electromagnetic-activation injector 58. The injector 58 is fixed to an outer surface of one of the guide blocks 54. The injector 58 has a supply port, which is connected to an additive supply source, or more specifically to a flavor additive supply source 60, through a supply hose. The flavor additive supply source 60 stores a liquid flavor additive such as menthol that is dissolved, for example, in glycerin, propylene glycol (PG) or alcohol. The liquid flavor additive is in a pressurized state in the flavor additive supply source 60. Therefore, the liquid flavor additive is directed from the supply source 60 through the supply hose to the injector 58. The injector 58 is filled with the liquid flavor additive.

The injector 58 is electrically connected to the electronic control unit 32. The electronic control unit 32 supplies a control signal toward the injector 58, to thereby control opening and closing of the injector 58. When opened, the injector 58 ejects the liquid flavor additive from a jet orifice thereof.

Figure 3:
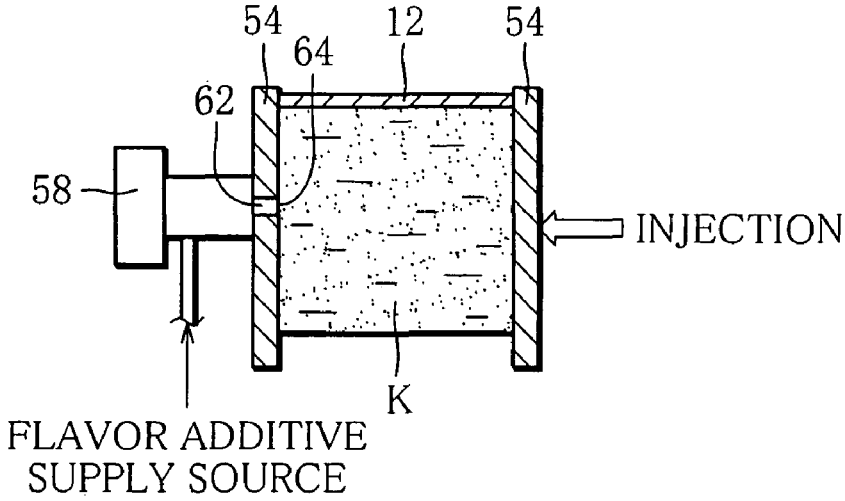
FIG. 3 is a cross sectional view of a guide block disposed in a terminal end portion of a molding path of FIG. 2.

As is obvious from FIG. 3, the jet orifice of the injector 58 is connected to an inner channel 62 of the guide block 54. The inner channel 62 has an injection opening 64 that opens in an inner surface of the guide block 54. Accordingly, the liquid flavor additive ejected from the jet orifice of the injector 58 is injected from the injection opening 64 into the material layer K through the inner channel 62.

As shown by an arrow in FIG. 3, it is possible to inject the liquid flavor additive into the material layer K from the other guide block 54. In this case, another inner channel with an injection opening is formed in the other guide block 56. This inner channel is connected to the flavor additive supply source 60 through an injector similar to the above-mentioned injector.

Figure 4:
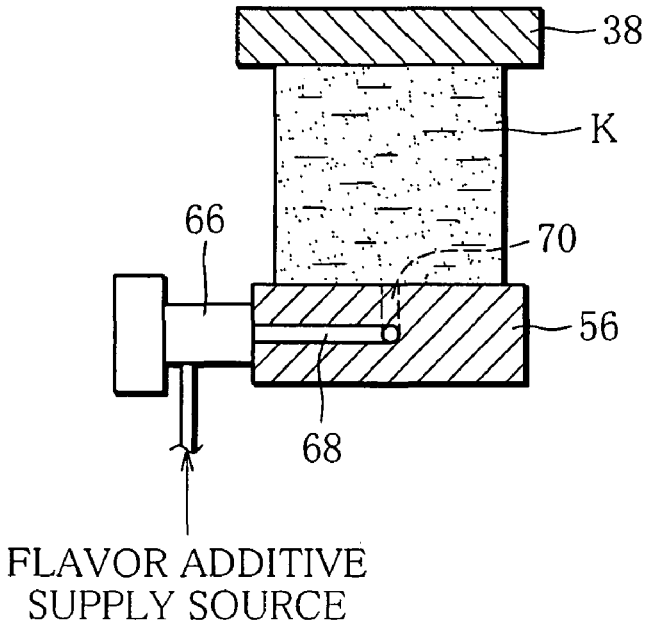
FIG. 4 is a cross sectional view showing a web shield of FIG. 2.

The addition device 57 includes an electromagnetic-activation injector 66 that is fixed to an outer surface of the web shield 56. The injector 66 is also connected to the flavor additive supply source 60 and the electronic control unit 32. As is clear from FIG. 4, there is formed an inner channel 68 in the web shield 56. The inner channel 68 is connected to a jet orifice of the injector 66 and has an injection opening 70 that opens in an upper surface of the web shield 56. Therefore, when the injector 66 is opened, the liquid flavor additive is ejected from the injection opening 70. The ejected liquid flavor additive is injected into the material layer K from a lower surface of the material layer K. As is apparent from FIG. 2, the injection opening 70 is located immediately above the web guide 36.

Figure 5:
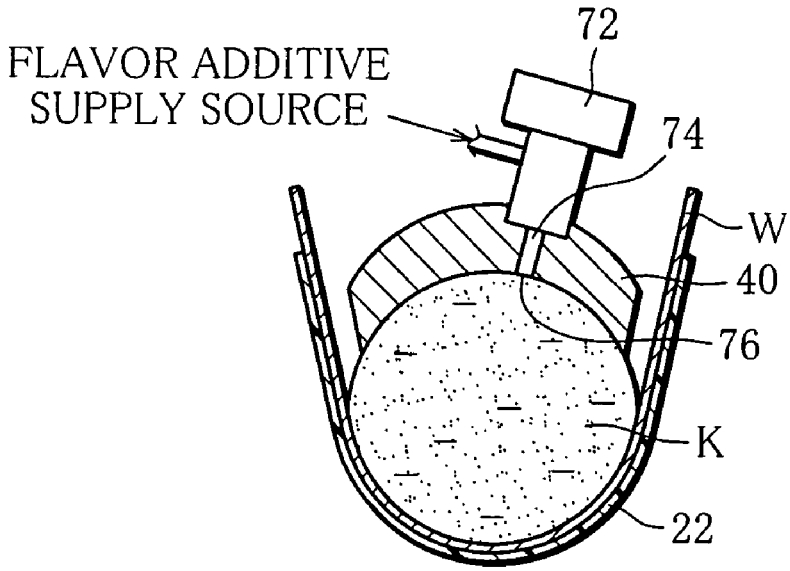
FIG. 5 is a cross sectional view, taken along line crossing in an upstream end of a tongue of FIG. 2.

As illustrated in FIG. 5, the addition device 57 includes an electromagnetic-activation injector 72 that is fixed to an outer surface of the tongue 40. The injector 72 is mounted on an upper surface of an upstream end of the tongue 40. The injector 72 is also connected to both the flavor additive supply source 60 and the electronic control unit 32. A jet orifice of the injector 72 is connected to an inner channel 74 formed in the tongue 40. The inner channel 74 has an injection opening 76 that opens in a lower surface of the tongue 40. When the injector 72 is opened, the liquid flavor additive is ejected from the injection opening 76. The ejected liquid flavor additive is injected into the material layer K from an upper surface of the material layer K.

Figure 6:
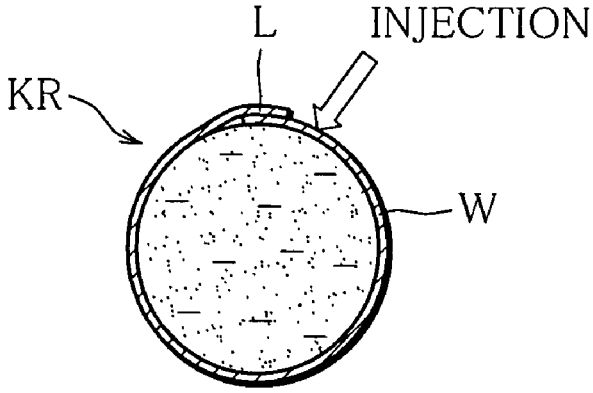
FIG. 6 is a cross sectional view of a rod.

As is evident from FIG. 5, the injection opening 76 is located so as to deviate from the center of a lower surface of the tongue 40, avoiding the center of the lower surface of the tongue 40. For this reason, when the rod KR is molded, it is possible, as illustrated in FIG. 6, to inject the liquid flavor additive into the material layer K from the injection opening 76 while avoiding a region of the material layer K which is covered with the lap portion L of the web W.

The electronic control unit 32 controls amount of the liquid flavor additive that is injected from the injectors 58, 66 and 72 into the material layer K. More specifically, the electronic control unit 32 increases or decreases opening of each injector according to the running speed of the garniture tape 22, or of the rod KR. Therefore, the injectors 58, 66 and 72 can inject the liquid flavor additive evenly per unit length of the material layer K.

Figure 7:
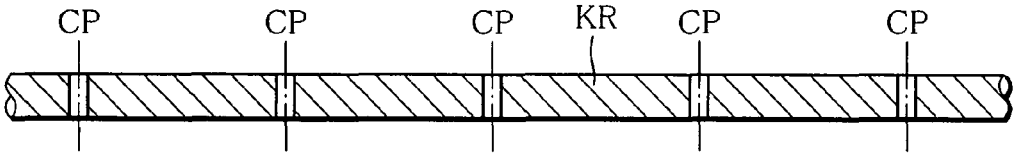
FIG. 7 is a view showing areas applied with a liquid flavor additive and areas not applied with a liquid flavor additive in the rod.

Based upon cut timing of the rod KR, the electronic control unit 32 activates the injectors 58, 66 and 72 so that they are closed intermittently and individually, and discontinues the injection of the liquid flavor additive from the injection openings 64, 70 and 76 into the material layer K. As a result, as illustrated in FIG. 7, addition areas added with the liquid flavor additive, which are shown with slant lines, and non-addition areas that are not added with the liquid flavor additive, which are shown in white, are alternately formed in the material layer K of the rod KR. An interval between the two adjacent non-addition areas is equal to length of a single rod-shaped smoking article A. The rod KR is cut in the center of the non-addition area, that is, at a cutting position CP. In this manner, the discrete rod-shaped smoking articles A are produced from the rod KR. As viewed in the running direction of the material layer K, the injection openings 64, 70 and 76 are located in different positions, so that timing in which the injectors 58, 66, 72 are activated into the closed positions is individually determined in accordance with distances between the respective injection openings and the cutter disc 52 in the cutting section 48 and the running speed of the material layer K.

As evidenced by the foregoing explanation, since the three injection openings 64, 70 and 76 are spaced from each other in the running and circumferential directions of the material layer K, the material layer K receives the injection of the liquid flavor additive from different positions. Therefore, the amount of the liquid flavor additive to be injected from each of the injection openings into the material layer K is reduced to one third of total addition amount of the liquid flavor additive required in the material layer K. Consequently, even if the material layer K runs at high speed, it is possible to fully enhance the efficiency of addition of the liquid flavor additive into the material layer K.

TABLE 1 below shows results of measurement in which the efficiency of addition of the liquid flavor additive was measured in respect to various cases where the number of the injection openings, the disposition of the injection openings, and injection amounts of the liquid flavor additive injected from the injection openings are varied. TABLE 1 also shows evaluations of flavor and taste of the rod-shaped smoking articles A.

TABLE 1

| | Disposition of the injection opening/Injection amount (g/min) | | | | |
|---|---|---|---|---|---|
| Total injection amount | Tongue | Guide block | Web shield | Efficiency of addition | Evaluation of smoking flavor |
| 100 | 100 | — | — | 0.88 | 3.5 |
| | — | 100 | — | 0.86 | 3.5 |
| | 50 | 50 | — | 0.91 | 4 |
| | — | 50 | 50 | 0.88 | 4 |
| | 50 | — | 50 | 0.89 | 4 |
| | 33.3 | 33.3 | 33.3 | 0.96 | 4.5 |
| 75 | 75 | — | — | 0.87 | 3.5 |
| | 37.5 | 37.5 | — | 0.90 | 4 |
| | 25 | 25 | 25 | 0.95 | 4.5 |
| 50 | 50 | — | — | 0.88 | 3.5 |
| | 25 | 25 | — | 0.91 | 4 |
| | 17 | 17 | 17 | 0.97 | 4 |

The efficiency of addition indicates proportion of content of the liquid flavor additive in the rod-shaped smoking article A to the injection amount of the liquid flavor additive injected from the injection opening. When the rod-shaped smoking article A was evaluated, substitutive cigarettes as disclosed in Japanese Patent No. 3472591 were produced using the rod-shaped smoking article A, and the substitutive cigarettes were smoked by three evaluation experts. When smoking, the experts judged mass of aerosol containing a flavor additive generated from the rod-shaped smoking article A, that is, mass of a mainstream smoke of the substitutive cigarettes. The result of this judgment is the evaluation of the rod-shaped smoking article A. The experts made the judgment on a scale of one to ten, with 5 being the highest score.

As is obvious from TABLE 1, both the efficiency of addition of the liquid flavor additive and the evaluation of a smoking flavor are high in proportion to the increase of the number of the injection openings. Regarding the total injection amount of the liquid flavor additive, the evaluation is high as the total injection amount is increased.

If the guide block 54, the web shield 56 and the tongue 40 have the injection openings 64, 70 and 76, respectively, the material layer K receives the injection of the liquid flavor additive from three places, that is, lateral, lower and upper surfaces thereof. Therefore, the injected liquid flavor additive is more evenly distributed in the material layer K. This is a significant factor for high scores on the evaluation of the rod-shaped smoking article A.

The injection openings 64, 70 and 76 are all disposed in an area between from the terminal end portion of the forming section 10 to the start end portion of the wrapping section 20. For this reason, the injection of the liquid flavor additive from the injection openings 64, 70 and 76 does not adversely affect the forming of the material layer K, so that the material layer K is stably formed on the suction belt 12.

When the liquid flavor additive is injected from the injection opening 70 into the material layer K, the web shield 56 prevents the web W from directly getting wet with the liquid flavor additive. In addition, when the liquid flavor additive is injected from the injection opening 76 into the material layer K, the lap portion L of the rod KR does not get wet with the liquid flavor additive. Accordingly, there generates no tear in the web W or poor adhesion in the lap portion L. It is possible to stably perform the wrapping of the material layer K in the web W, that is, the forming of the rod KR.

Since the injection openings 70 and 76 are arranged upstream from the tongue 40, the material layer K is not compressed by the tongue 40 when passing through the injection openings 70 and 76. Consequently, the liquid flavor additive ejected from the injection openings 70 and 76 is injected into the material layer K without difficulty.

The amount of the liquid flavor additive that is injected from the injection openings 64, 70 and 76 into the material layer K is increased or decreased according to the running speed of the material layer K. As a result, the amounts of the liquid flavor additive that is added into the respective rod-shaped smoking articles A are the same regardless of speed of manufacturing the rod KR.

Since the rod KR is cut in the non-addition areas (see FIG. 7) that are not added with the liquid flavor additive, the liquid flavor additive does not adhere to the cutter blade of the cutter disc 52 during cutting. Consequently, the cutter blade is not deteriorated in durability.

The present invention is not limited to the foregoing one embodiment, and may be modified in various ways. For instance, the addition device 57 may include injection openings provided to two of the guide block 54, the web shield 56 and the tongue 40.

Figure 8:
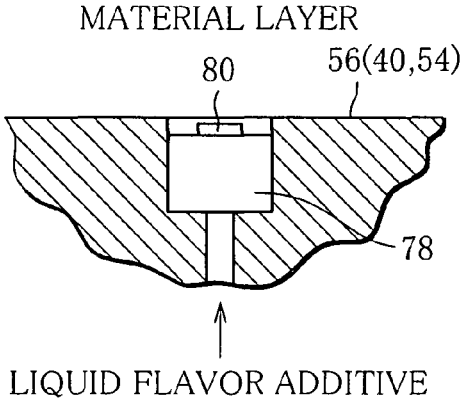
FIG. 8 is a view showing a spray nozzle having a jet orifice.
Figure 9:
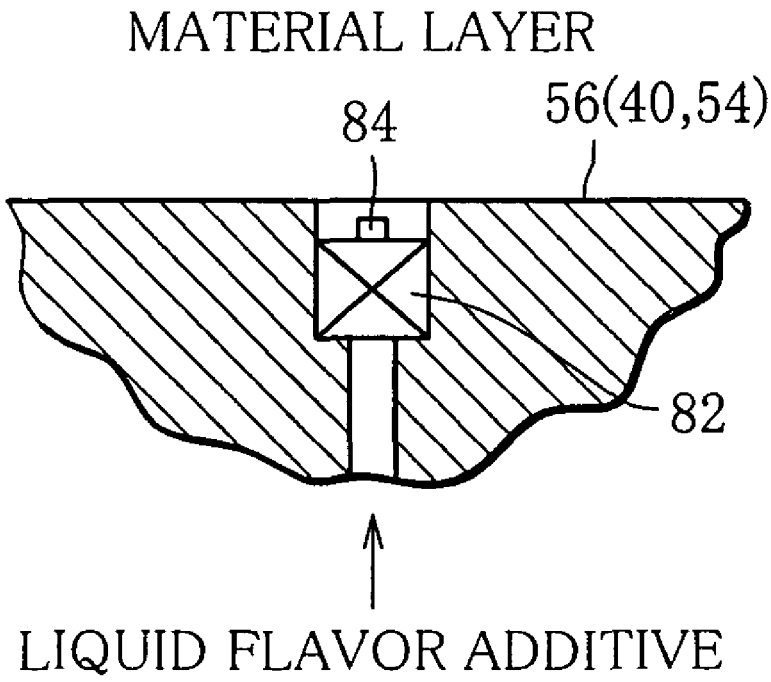
FIG. 9 is a view showing a microsolenoid valve having a discharge orifice.

As illustrated in FIGS. 8 and 9, the inner channel may have a spray nozzle 78 or a solenoid valve 82 in the opening end thereof. In this case, a spray orifice 80 of the spray nozzle 78 or a discharge orifice 84 of the microsolenoid valve 82 serve as an injection opening of the addition device 57. Instead of the spray nozzle 78 and the microsolenoid valve 72, an ink jet nozzle may be utilized. The spray nozzle 78, the microsolenoid valve 82 or the ink jet nozzle can be disposed close to the flow of the material layer, as compared to the injectors 58, 66 and 72. Accordingly, when the non-addition areas shown in FIG. 7 are secured, it is possible to form the non-addition areas with high accuracy.

The manufacturing apparatus of the present invention is applicable to manufacture of common cigarette rods, other than the manufacture of elements of the substitutive cigarettes. In that case, the material layer is made up of a mixture of shred tobacco, shreds obtained by cutting a sheet-like reconstituted tobacco, and shred tobacco subjected to an expanding process. As to the liquid flavor additive, a liquid flavor corresponding to a brand of the cigarette rod is used.

When the liquid flavor is added to the material layer on the manufacturing apparatus of cigarette rods, it is possible to omit the step of adding flavor to smoking material using a rotor-type flavor adding machine and the subsequent step of curing the smoking material by means of a silo or the like.

Furthermore, the manufacturing apparatus of the present invention may be used for addition of various kinds of liquid additives other than liquid flavor additive.

The invention claimed is:

1. An apparatus for manufacturing rod-shaped smoking articles, comprising:

a forming section including a forming path, for forming a material layer made up of particles of smoking material on the forming path, and delivering the material layer along the forming path, said forming section further including a pair of guide members disposed in the terminal end portion thereof, for guiding both sides of the material layer;

a wrapping section including a wrapping path, for receiving the material layer from the forming path of said forming section, forming a rod in which the material layer is continuously wrapped in a web in the process where the material layer travels along the wrapping path, and delivering the formed rod, wherein the rod has a lap portion formed by bonding both side edges of the web together in a state where the side edges are superposed upon each other said wrapping section further including:

a compression member disposed above the web in the start end portion of the wrapping path, for compressing the material layer from above, and a web shield located between an upstream end portion of the compression member and the web in the start end portion of the wrapping path, for separating the material layer and the web from each other the web shield and the compression member overlapping with each other as viewed in a vertical direction, wherein at least two among the guide member, the upstream end portion of the compression member and the web shield have respective injection openings, a cutting section for cutting the rod delivered from said wrapping section into rod-shaped smoking articles having given length; and an addition device for adding a liquid additive to the material layer by injecting the additive from the injection openings into the material layer wherein the injection openings are spaced from each other in a traveling direction of the material layer and also in a circumferential direction of the material layer.

2. The apparatus according to claim 1, wherein:

in a case that the compression member has the injection opening, the injection opening is positioned so as to avoid a portion of the material layer, which is covered with the lap portion of the web.

3. The apparatus according to claim 1, wherein:

in a case that the web shield has the injection opening, the injection opening is positioned upstream from the compression member as viewed in the traveling direction of the material layer.

4. The apparatus according to claim 1, wherein:

said addition device further includes regulation means for controlling the injection amount of the additive to be injected from the injection openings according to traveling speed of the rod.

5. The apparatus according to claim 1, wherein:

said addition device further includes control means for intermittently halting the injection of the additive for the purpose of avoiding the injection of the additive into predetermined cut points of the rod.

6. The apparatus according to claim 1, wherein:

said additive is a liquid flavor additive containing alcohols.

7. The apparatus according to claim 1, wherein:

the injection opening is a spray orifice of a spray nozzle.

8. The apparatus according to claim 1, wherein:

the injection opening is a discharge orifice of a microsolenoid valve.

* * * * *

UNITED STATES PATENT AND TRADEMARK OFFICE

CERTIFICATE OF CORRECTION

PATENT NO. : 8,118,033 B2
APPLICATION NO. : 11/812066
DATED : February 21, 2012
INVENTOR(S) : Makoto Sendo et al.

It is certified that error appears in the above-identified patent and that said Letters Patent is hereby corrected as shown below:

ON THE TITLE PAGE:

Insert the following:

-- Related U.S. Application Data

(63) Continuation of application No. PCT/JP2005/022472, filed on Dec. 7, 2005. --.

and

-- (30) Foreign Application Priority Data

Dec. 15, 2004 (JP) ..... 2004-363049 --.

Signed and Sealed this
Twenty-ninth Day of May, 2012

David J. Kappos

David J. Kappos
*Director of the United States Patent and Trademark Office*